US006369767B1

(12) United States Patent
Oka et al.

(10) Patent No.: US 6,369,767 B1
(45) Date of Patent: Apr. 9, 2002

(54) VEHICLE GLASS ANTENNA

(75) Inventors: Hidetoshi Oka; Hiroshi Iijima, both of Osaka (JP)

(73) Assignee: Nippon Sheet Glass, Co., Ltd., Osaka (JP)

( * ) Notice: Subject to any disclaimer, the term of this patent is extended or adjusted under 35 U.S.C. 154(b) by 0 days.

(21) Appl. No.: 09/711,204

(22) Filed: Nov. 9, 2000

(30) Foreign Application Priority Data

Nov. 10, 1999 (JP) ..... 11-319037

(51) Int. Cl.[7] ..... H01Q 1/32
(52) U.S. Cl. ..... 343/713; 343/711
(58) Field of Search ..... 343/711, 712, 343/713

(56) References Cited

U.S. PATENT DOCUMENTS 5,598,170 A * 1/1997 Nakase ..... 343/704
5,905,470 A * 5/1999 Fujii et al. ..... 343/713
6,292,149 B1 * 9/2001 Endo et al. ..... 343/713

FOREIGN PATENT DOCUMENTS

JP 02000013120 A * 1/2000 ..... H01Q/1/32
JP 2001127519 A * 5/2001 ..... H01Q/1/32

* cited by examiner

*Primary Examiner*—Don Wong
*Assistant Examiner*—Shih-Chao Chen
(74) *Attorney, Agent, or Firm*—Merchant & Gould PC

(57) ABSTRACT

The invention provides a glass antenna having an impedance that is close to the characteristic impedance of the antenna's feeder cable, even when an impedance matching circuit is not provided. A vehicle glass antenna includes a VHF band antenna provided on a window glass of a vehicle. The VHF band antenna includes (i) an antenna pattern including a first element extending substantially straight; a bend portion bending away from the first element; and a second element that is substantially parallel to the first element, extending from the bend portion, (ii) a grounding point to which the second element is connected; and (iii) a feeding point for the VHF band antenna.

10 Claims, 9 Drawing Sheets

811 FORWARD REFLECTION
IMPEDANCE

811 FORWARD REFLECTION
IMPEDANCE

PRIOR ART

VEHICLE GLASS ANTENNA

BACKGROUND OF THE INVENTION

1. Field of the Invention

The present invention relates to glass antennas for vehicles, and in particular to glass antennas applied to side glasses or rear glasses of vehicles.

2. Description of the Related Art

Glass antennas in which antenna conductors are formed on a vehicle window glass are superior to conventional rod antennas in that (i) they are designed not to protrude outward, (ii) there is little danger of breakage, and (iii) they do not cause wind noise. For these and other reasons, such glass antennas are widely used.

For example, JP H9-284025A discloses a vehicle glass antenna that is applied to a side glass. With this antenna, a glass antenna is proposed in which the receiving gain is increased over a broad spectrum from FM radio broadcasts to UHF TV broadcasts, while occupying only a little space. The specific antenna pattern is shown in FIG. 9A. One pattern 15 that is disclosed is an antenna pattern including a first horizontal line 151 extending substantially horizontally from a feeding point, a bend portion 152 bending away from the first horizontal line 151, and a second horizontal line 153 extending from the bend portion and substantially parallel to the first horizontal line 151.

Also JP H9-116327A (see FIG. 9B) and JP H10-51219A (see FIG. 9C) disclose glass antennas 15 having a bend portion 152 and linear portions 151 and 153 that are arranged substantially in parallel.

With regard to high frequency antennas, and in particular glass antennas for car telephones, for example JP H11-17429A and JP H11-127011A disclose glass antennas, in which antenna conductors, feeding points and grounding points are provided on an automobile window glass.

However, all of the antenna patterns disclosed in JP H9-284025A, JP H9-116327A and JP H10-51219A are monopole antennas.

These monopole antennas have an impedance that is lower than the characteristic impedance of the antenna's feeder cable (coaxial cable). Therefore, this impedance mismatch with the feeder cable causes a loss in the receiving sensitivity. As a countermeasure, these conventional antennas often use impedance matching circuits.

However, such impedance matching circuits are also a reason for additional cost.

SUMMARY OF THE INVENTION

It is an object of the present invention to solve these problems and to provide a glass antenna having an impedance that is close to the characteristic impedance of the antenna's feeder cable, even when an impedance matching circuit is not provided.

It is another object of the present invention to provide a VHF band glass antenna that can be arranged on a small space.

The design considerations of the present invention for attaining these objects are as follows.

A glass antenna that can receive the VHF band (specifically, frequencies of 76 to 108 MHz) is provided, for example, on a side glass of a vehicle. If the design frequency is taken as, for example, 90 MHz ($\lambda/4 \approx 0.83$ m), then it often can not be fitted onto the side glass as a straight pattern.

Therefore, the antenna pattern is bent into a so-called bent antenna. However, this lowers the impedance of the antenna, as explained above. But by connecting the antenna with ground, the impedance of the antenna pattern is increased and brought closer to the impedance of the feeder cable.

This also can be thought of as making a monopole antenna of a bent dipole antenna.

Thus, in accordance with the present invention, a vehicle glass antenna includes a VHF band antenna provided on a window glass of a vehicle. The VHF band antenna includes an antenna pattern, a grounding point and a feeding point for the VHF band antenna. The antenna pattern includes a first element extending substantially straight, a bend portion bending away from the first element, and a second element that is substantially parallel to the first element extending from the bend portion. The second element is connected to the ground point.

In the vehicle glass antenna, it is preferable that the feeding point and the grounding point are provided in the vicinity of one side of the window glass.

It is preferable that the feeding point and the grounding point are provided in the vicinity of one corner of the window glass.

It is preferable that the first element of the VHF band antenna is provided with a bypass pattern.

It is preferable that the window glass is a side window glass or a rear window glass.

It is preferable that the window glass is either a fixed window glass or a hinged window glass that can be opened and closed.

It is preferable that the vehicle glass antenna further includes a medium frequency (MF) band antenna. It is preferable that the MF band antenna of the vehicle glass is substantially made of one straight pattern.

It is preferable that a feeding point of the MF band antenna of the vehicle glass antenna of claim 8 is arranged near the feeding point and the grounding point of the VHF band antenna.

DESCRIPTION OF THE PREFERRED EMBODIMENTS

The following is a detailed description of the present invention, with reference to the preferred embodiments. An aspect of the present invention directed to an antenna for the VHF band, but if necessary, it is also possible to use an antenna for the MF band (AM antenna) formed on the same glass surface.

Embodiment 1

Figure 1:
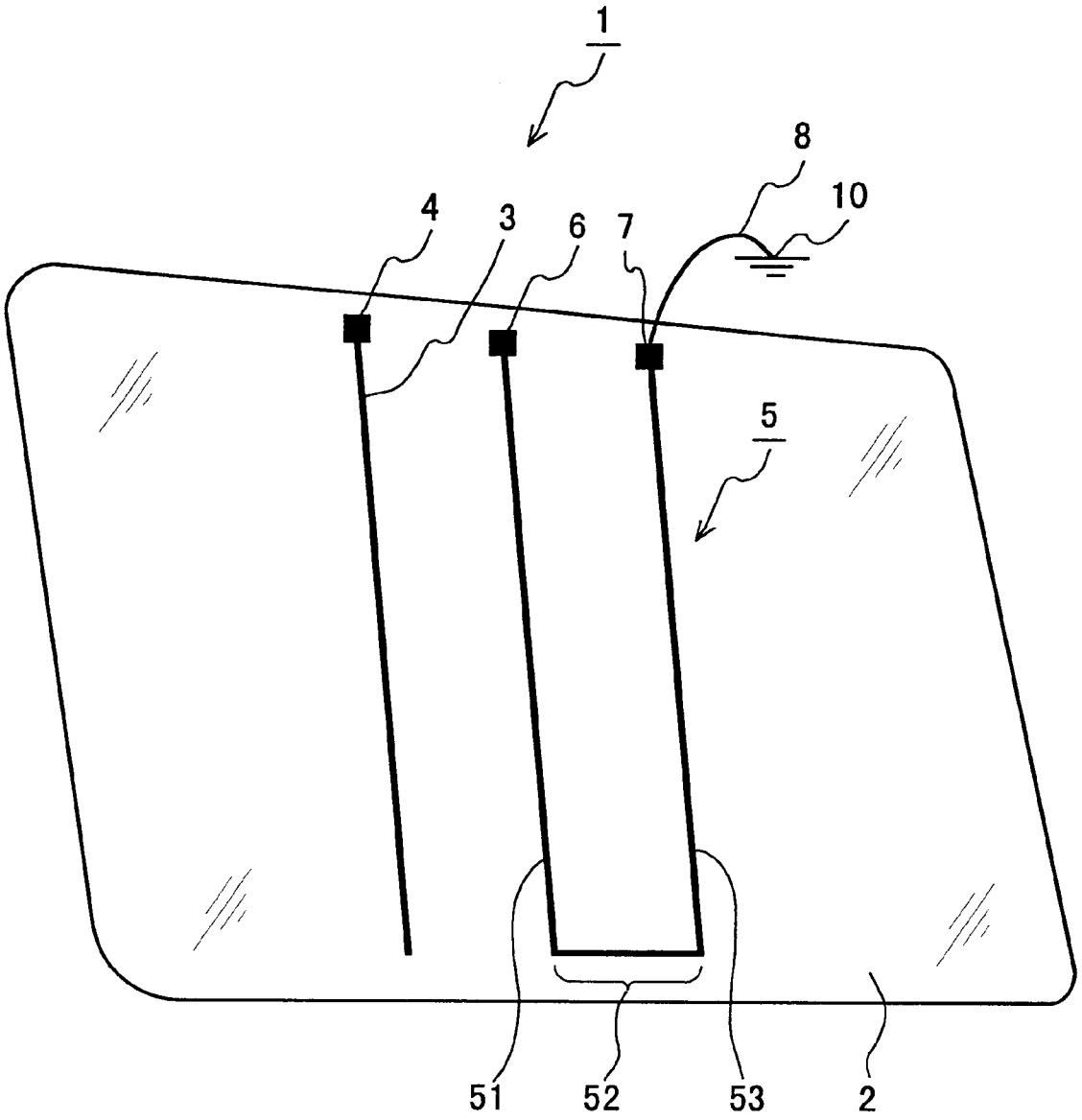
FIG. 1 shows an embodiment of a glass antenna in accordance with the present invention.

FIG. 1 shows a glass antenna serving as an example of the basic configuration of the present invention. The glass antenna 1 is provided on a side glass 2. This side glass 2 is a glass sheet for a side window of a automobile, for example a wagon-type automobile.

As shown in FIG. 1, the glass antenna 1 includes an AM antenna 3 serving as an MF band antenna, a feeding point 4 for the MF band antenna (AM antenna), an FM antenna 5 serving as a VHF band antenna, a feeding point 6 for the VHF band antenna (FM antenna), and a grounding point 7 for the VHF band antenna (FM antenna).

The feeding points 4 and 6 and the grounding point 7 of the two antennas are provided near the upper side of the side glass.

The VHF band antenna 5 includes an antenna pattern of a first element 51 extending substantially straight, a bend portion 52 bending away from the first element 51, and a second element 53 extending from the bend portion 52 and running substantially parallel to the first element 51. The second element 53 is connected to the grounding point 7.

It is preferable that the length of the first element 51 of the VHF band antenna pattern is about 200 to 700 mm. Considering the outward appearance and cost factors, it is preferable that its line width is not more than about 5 mm.

It is also preferable that the spacing of the parallel portions (that is, the bend portion) is at least 10 mm. There is no specific upper limit for this spacing. However, when the spacing is too large, it may obstruct the possibility to form a VHF band antenna pattern on a small surface area, which is one of the features of the present invention, so that a spacing of at most 200 mm, more preferably at most 100 mm, is preferable.

This VHF band antenna pattern is connected to a feeding point 4. The grounding point 7 is grounded to the car body 10 via a connection wire 8.

Furthermore, it is preferable that the VHF band antenna pattern is provided at the center of the glass.

The MF band antenna (AM antenna) 3 is for reception of the MF band and is made of a substantially straight antenna pattern. It is preferable that the total length of this antenna pattern is at least 300 mm. Considering the outward appearance and cost factors, it is preferable that its line width is not more than about 5 mm.

The MF band antenna pattern is connected to a feeding point 4 provided near the upper side of the side glass.

Embodiments 2 and 3

Figure 2:
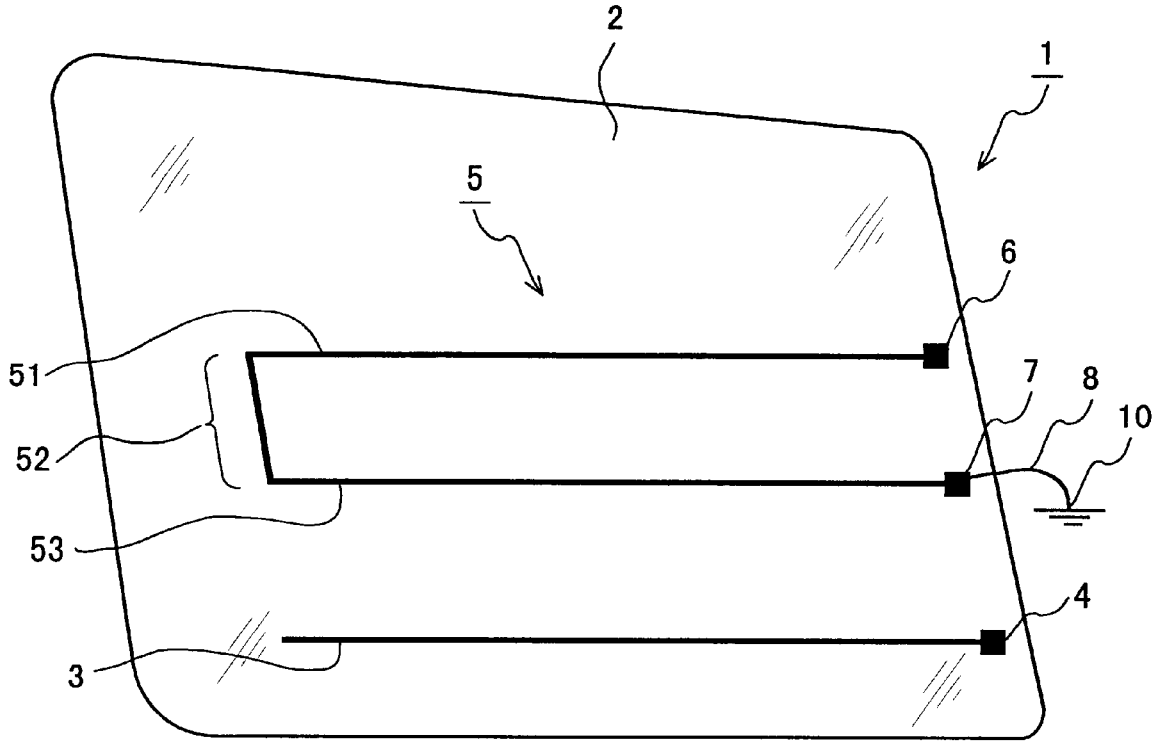
FIG. 2 shows another embodiment of a glass antenna in accordance with the present invention.
Figure 3:
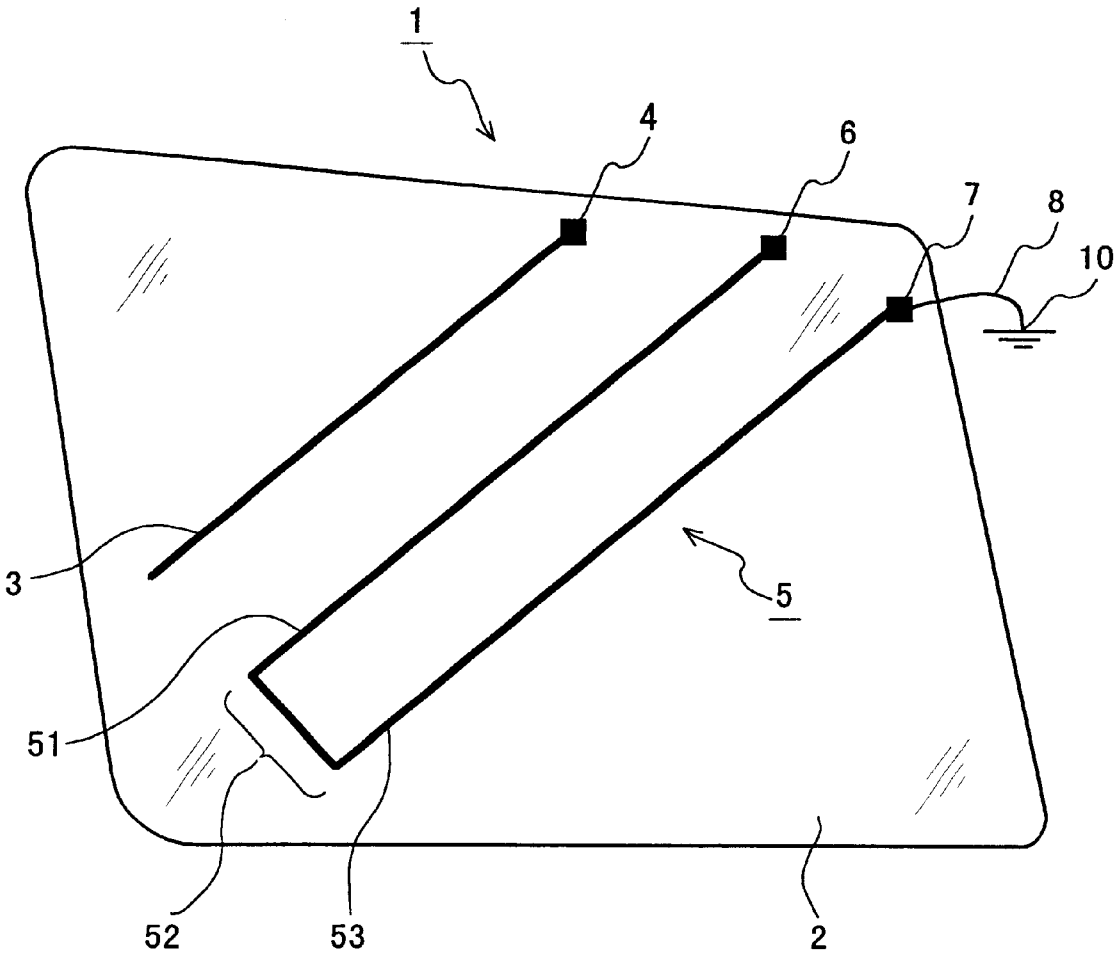
FIG. 3 shows another embodiment of a glass antenna in accordance with the present invention.

FIGS. 2 and 3 show glass antennas in other embodiments of the present invention. All of these are examples in which the glass antennas are provided on the side glass.

The glass antenna 1 in FIG. 2 is an example in which the two feeding points 4 and 6 and the grounding point 7 are provided near a lateral side portion of the side glass.

The glass antenna 1 in FIG. 3 is an example in which the two feeding points 4 and 6 and the grounding point 7 are provided near a corner of the side glass.

The configuration of the vehicle glass antennas in these Embodiments 1, 2 and 3 offers the advantage that only a small area is occupied by the antenna patterns.

Embodiment 4

Figure 4:
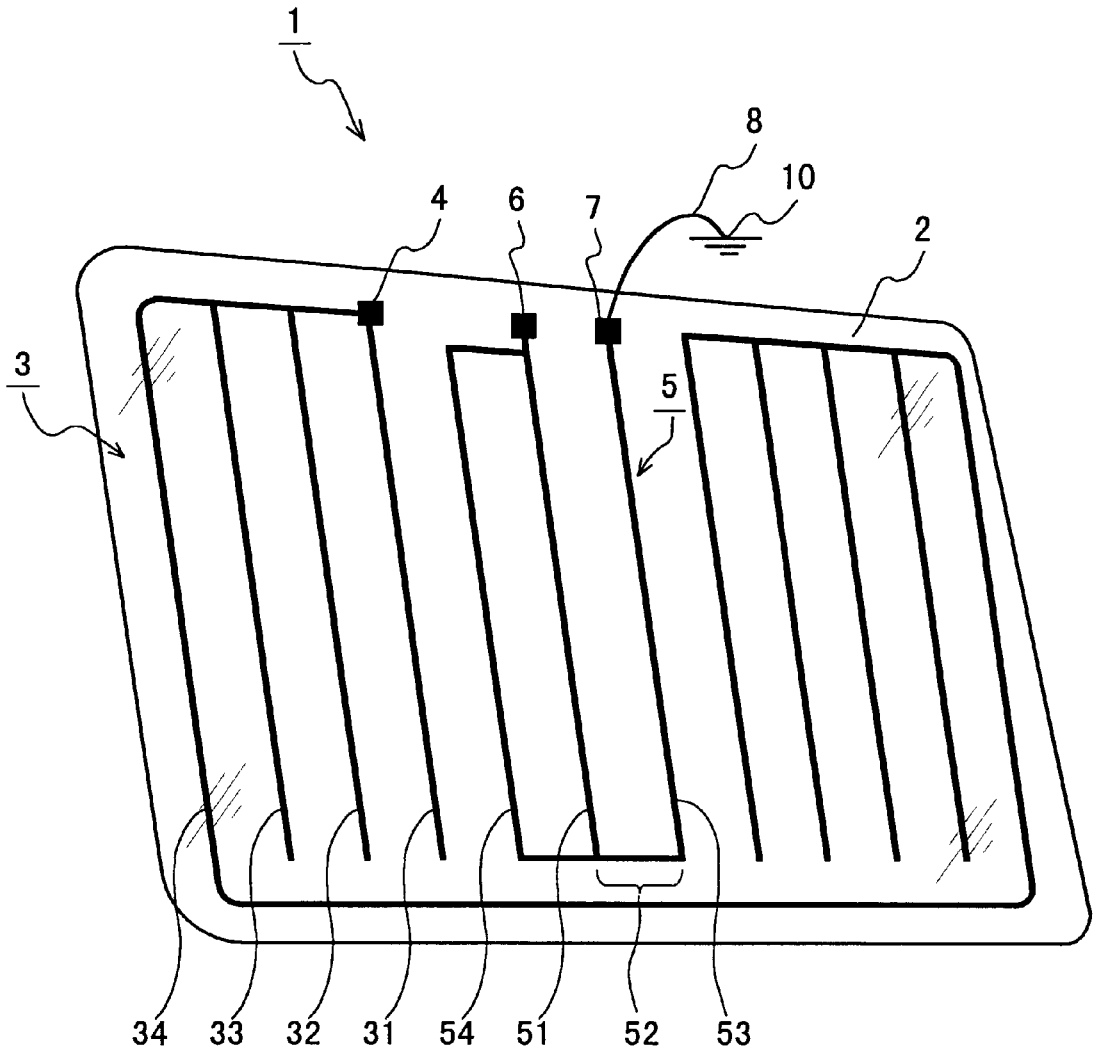
FIG. 4 shows yet another embodiment of a glass antenna in accordance with the present invention.

FIG. 4 shows a glass antenna in yet another embodiment of the present invention. The glass antenna 1 in FIG. 4 is an example in which the AM antenna 3 is made of a plurality of straight elements (31, 32, 33, 34 . . . ). Moreover, in order to maximize the area occupied by the antenna pattern of this AM antenna 3, the pattern is formed at substantially all portions of the glass, except for those portions where the FM antenna 5 is formed. The spacing between the plurality of straight elements was set at 50 mm.

The VHF band antenna 5 includes an antenna pattern of a first element 51 extending substantially straight, a bend portion 52 bending away from the first element 51, and a second element 53 extending from the bend portion 52 and running substantially parallel to the first element 51. The second element 53 is connected to the grounding point 7.

In order to increase the receiving sensitivity, the FM antenna 5 is provided with a bypass pattern 54 that is substantially parallel to the first element 51. In this embodiment, the length of the first element 51 was set at 360 mm and the length of the bend portion 52 was set at 50 mm. Moreover, the spacing between the bypass pattern 54 and the first element 51 was set at 50 mm. In all of these patterns, the line width was set to 0.5 mm.

In this Embodiment 4, a bypass pattern 54 is provided, which is equivalent to broadening the width of the antenna pattern and leads to the effect that the receiving sensitivity is improved.

Embodiment 5

Figure 5:
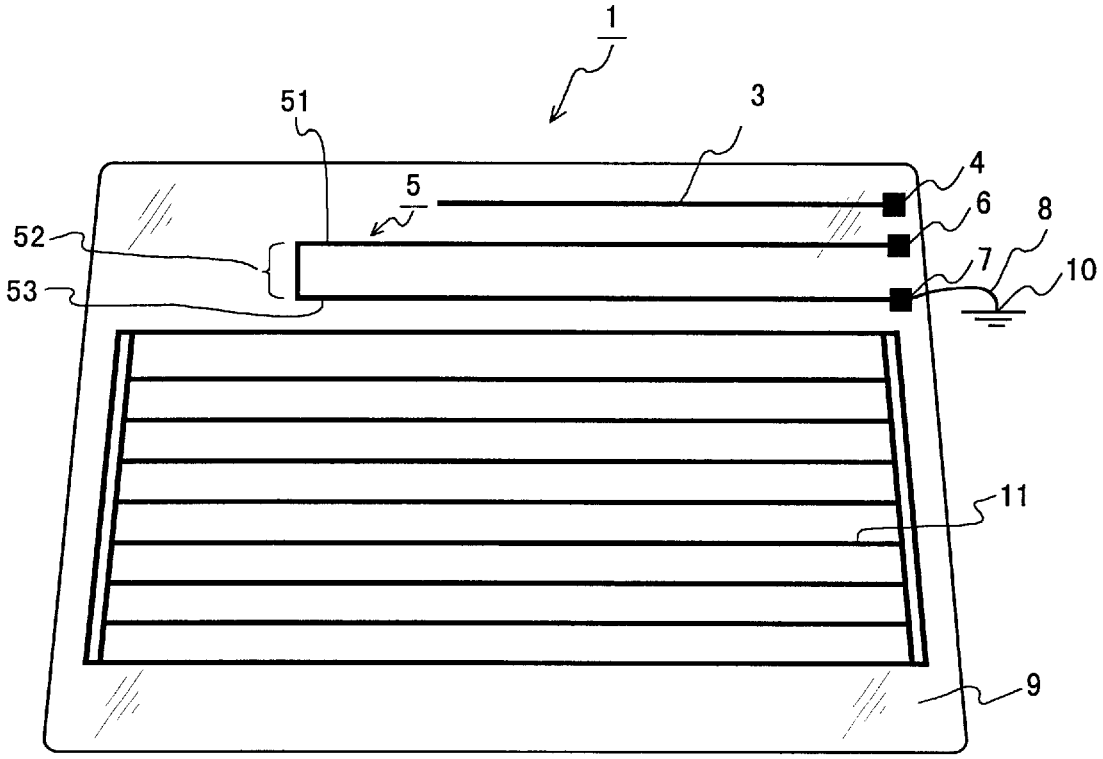
FIG. 5 shows an embodiment in which the glass antenna of the present invention is provided on the rear glass.

The preceding embodiments are examples in which the antenna was provided on a side window glass, but this Embodiment 5 is an example in which the antenna is provided on the rear window glass (see FIG. 5).

The rear window glass 9 is provided with a defogger 11 for defogging. In this example, the glass antenna 1 of the present invention is provided in the empty space above the defogger 11.

Comparative Embodiment

Figure 6:
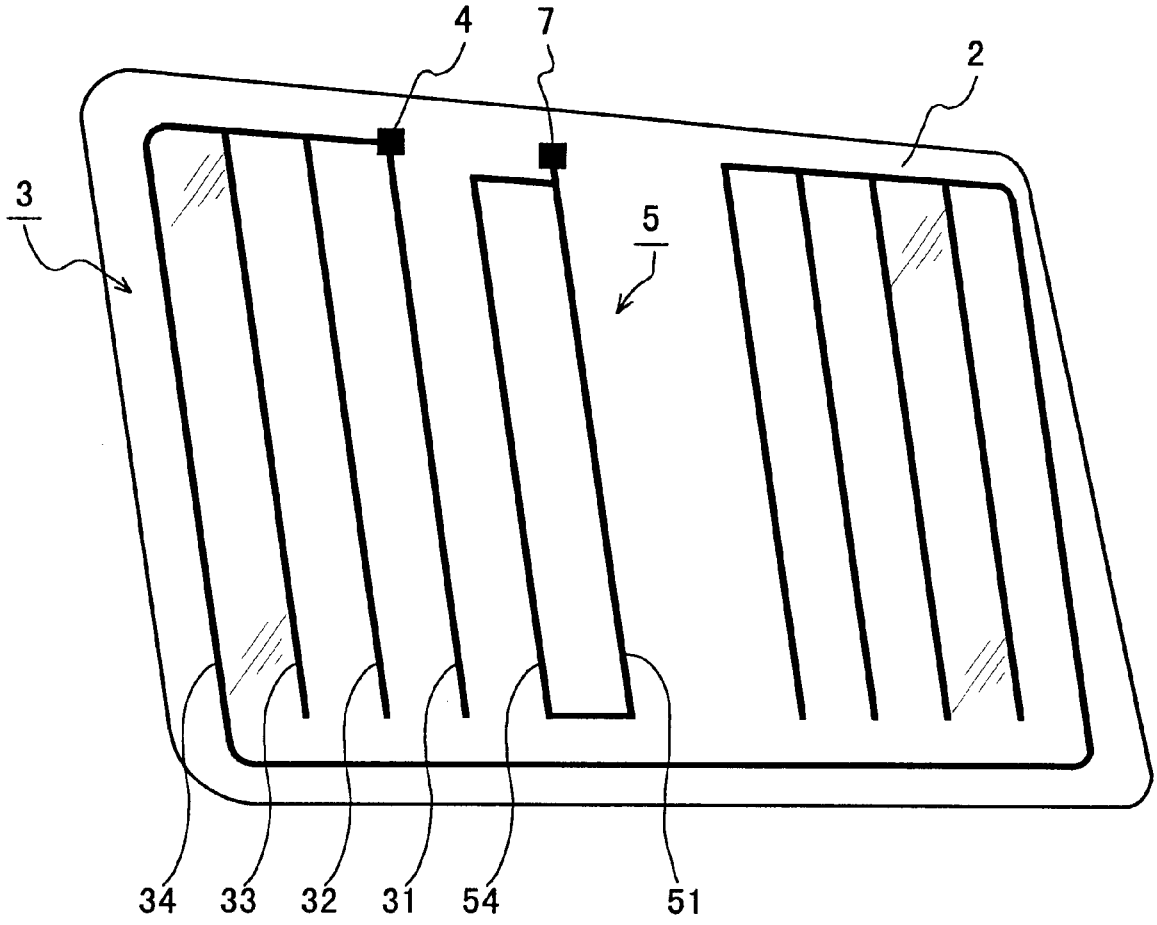
FIG. 6 shows a glass antenna in a Comparative Embodiment.

The Comparative Embodiment is an antenna pattern in which the portion corresponding to the second element 53 of the FM antenna is missing from the glass antenna of Embodiment 4, and the FM antenna is not connected to a grounding point (see FIG. 6).

Figure 7:
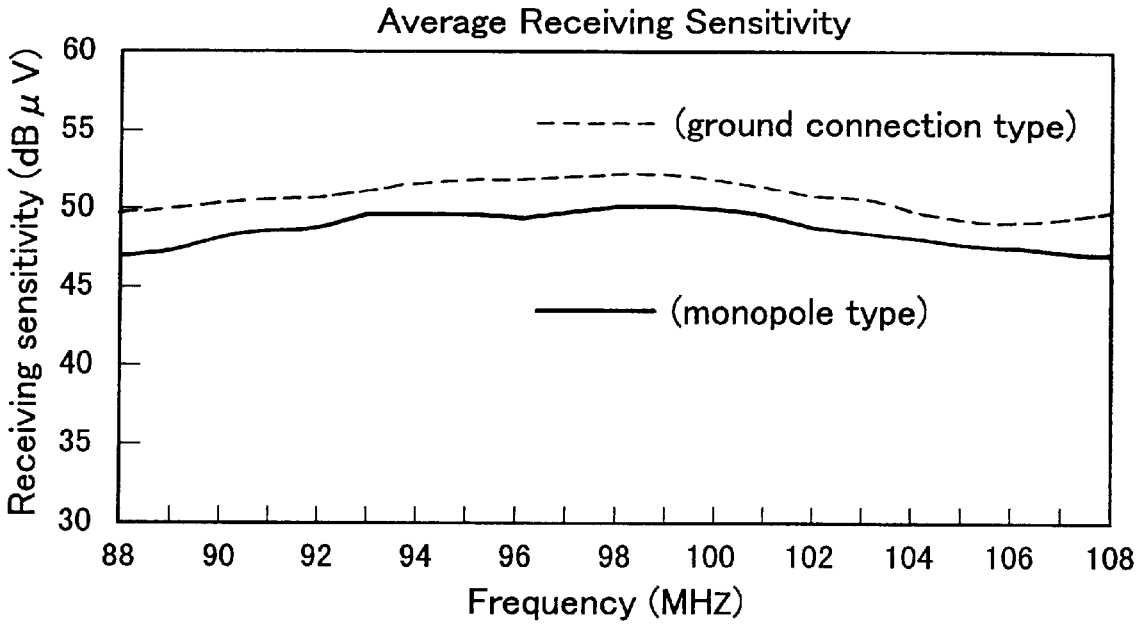
FIG. 7 illustrates the measured average receiving sensitivity.
Figure 8A:
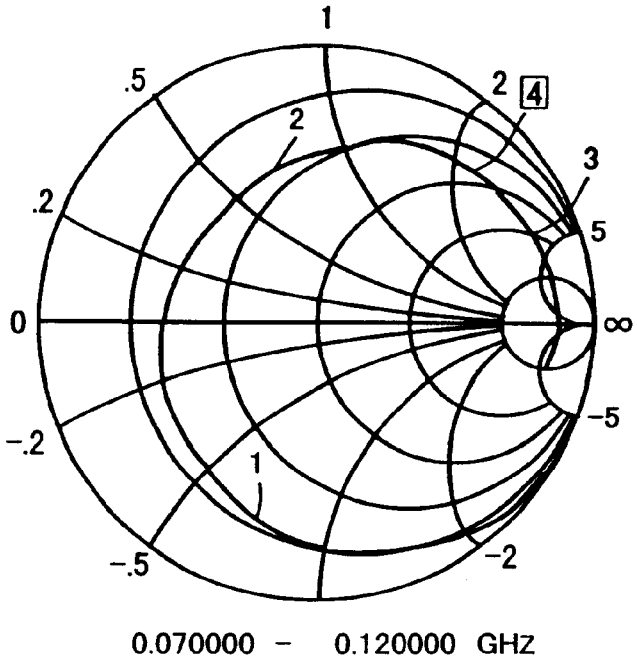
FIGS. 8A and 8B illustrate the measured impedances.
Figure 8B:
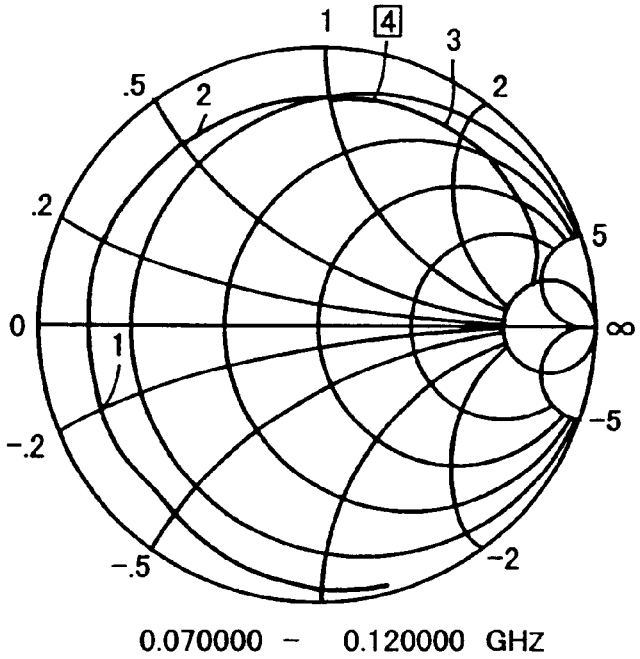
Figure 9A:
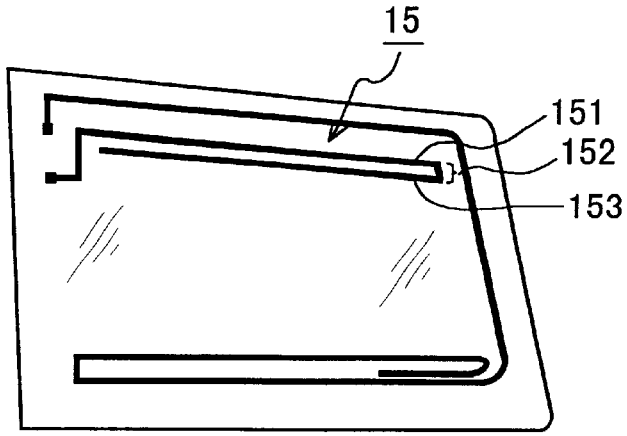
FIGS. 9A, 9B and 9C show the pattern of a conventional vehicle glass antenna.
Figure 9B:
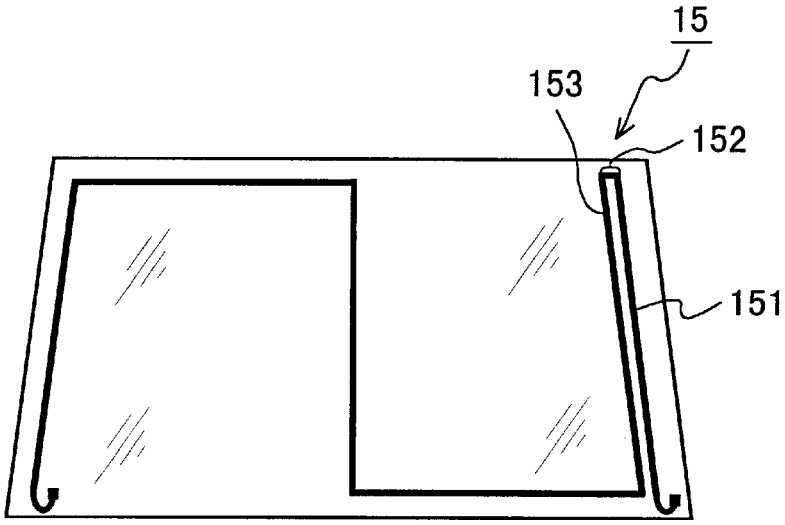
Figure 9C:
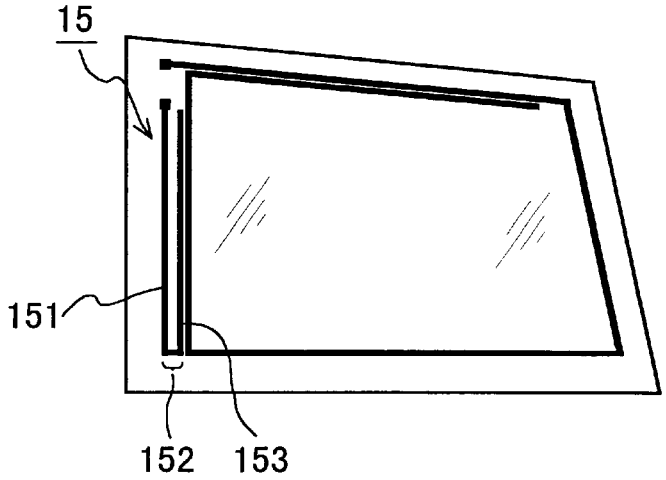

FIGS. 7, 8A, 8B and the following table illustrate the average receiving sensitivity in Embodiment 4 (ground connection type) and the Comparative Embodiment (monopole type), as well as the impedances in a 50 Ω system measured with a network analyzer.

| frequency (MHz) | Embodiment 4 (Ω) | Comp. Embodiment (Ω) |
|---|---|---|
| 88 | 11 | 4 |
| 98 | 20 | 6 |
| 108 | 104 | 15 |

As becomes clear from FIG. 7, across the entire frequency band, the sensitivity of the vehicle glass antenna in Embodiment 4 is about 2 dB better than that of the comparative monopole-type glass antenna.

As becomes clear from the table, the vehicle glass antenna of Embodiment 4 is closer to the 50 Ω impedance of the feeder cable than the comparative monopole-type glass antenna.

All of the above-noted embodiments are examples in which the glass antenna is provided on a fixed window glass.

However, it should be noted that there is no limitation to this, and it is also possible to provide the glass antenna on a hinged window glass that can be opened and closed.

As should become clear from the foregoing explanations, in the vehicle glass antennas of the present invention, an FM antenna is formed into a bent antenna and also connected to a grounding point.

Therefore, since it functions as a bent antenna, the impedance of the antenna can be increased, and it is possible to come closer to the characteristic impedance of the feeder cable. Moreover, the vehicle glass antennas of the present invention do not use an impedance matching circuit, which is advantageous with regard to costs.

In the vehicle glass antenna of the present invention, it is also possible to include an MF band antenna made of a straight pattern, in addition to the VHF band antenna with the elongated bent pattern. With this configuration, it is possible to provide independently an MF band antenna and a VHF band antenna, even on a glass that is as narrow as, for example, 50 mm.

Furthermore, the feeding points and the grounding point are provided near a side or a corner of the glass, so that the antenna feeder cable and the grounding connection line can be connected easily.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A vehicle glass antenna including a VHF band antenna provided on a window glass of a vehicle, the VHF band antenna comprising:

an antenna pattern including a first element extending substantially straight;

a bend portion bending away from the first element; and a second element that is substantially parallel to the first element, extending from the bend portion;

a grounding point to which the second element is connected; and a feeding point for the VHF band antenna.

2. The vehicle glass antenna of claim 1, wherein the feeding point and the grounding point are provided in the vicinity of one side of the window glass.

3. The vehicle glass antenna of claim 1, wherein the feeding point and the grounding point are provided in the vicinity of one corner of the window glass.

4. The vehicle glass antenna of claim 1, wherein the first element of the VHF band antenna is provided with a bypass pattern.

5. The vehicle glass antenna of claim 1, wherein the window glass is a side window glass.

6. The vehicle glass antenna of claim 1, wherein the window glass is a rear window glass.

7. The vehicle glass antenna of claim 1, wherein the window glass is either a fixed window glass or a hinged window glass that can be opened and closed.

8. The vehicle glass antenna of claim 1, further comprising an MF band antenna.

9. The vehicle glass antenna of claim 8, wherein the MF band antenna is substantially made of one straight pattern.

10. The vehicle glass antenna of claim 8, wherein a feeding point of the MF band antenna is arranged in the vicinity of the feeding point and the grounding point of the VHF band antenna.

* * * * *